United States Patent [19]

Fair

[11] 4,174,042

[45] Nov. 13, 1979

[54] GUN LOCKING DEVICE

[76] Inventor: Rickey F. Fair, 3190 McMinn Rd., Sharpsville, Pa. 16150

[21] Appl. No.: 917,090

[22] Filed: Jun. 19, 1978

[51] Int. Cl.[2] ..... E05B 73/00; A47F 7/00; A47B 81/00

[52] U.S. Cl. ..... 211/8; 211/64

[58] Field of Search ..... 211/4, 8, 9, 60 SK, 211/60 T, 62, 63, 64, 68; 70/58, 59, 61, 62; 248/507; 269/165, 172, 184

[56] References Cited

U.S. PATENT DOCUMENTS

| | | | |
|---|---|---|---|
| 505,320 | 9/1893 | Meadows | 211/4 X |
| 569,422 | 10/1896 | Main | 211/8 |
| 573,258 | 12/1896 | Brand | 211/8 |
| 615,821 | 12/1898 | Dockstader | 211/4 |
| 1,221,584 | 4/1917 | Patrick | 211/8 |
| 2,831,335 | 4/1958 | Kidd et al. | 70/58 |
| 2,998,885 | 9/1961 | Surface | 211/64 |
| 3,917,071 | 11/1975 | Walters | 211/4 X |
| 4,018,339 | 4/1977 | Pritz | 211/8 |
| 4,107,958 | 8/1978 | Manley | 211/8 X |
| 4,132,315 | 1/1979 | Young | 211/64 X |

FOREIGN PATENT DOCUMENTS

| | | | |
|---|---|---|---|
| 50335 | 1/1911 | Switzerland | 211/62 |
| 174302 | 1/1935 | Switzerland | 211/8 |

*Primary Examiner*—Thomas J. Holko

*Attorney, Agent, or Firm*—Gamble, Verterano, Mojock and Green

[57] ABSTRACT

This invention is directed to a mechanism for locking and restraining one or more objects of various lengths and diameters or widths in a holding rack of the type in which an end of the object is seated in a depression in a fixed base, the base being secured immovably. The disclosed invention includes a shaft which has a radius which varies with respect to a longitudinal axis for pivoting and further has notches along its length at the point of its largest radius. A cap member, receptive to an end of the object not seated in the base, is slidably mounted upon the shaft and is able to engage the notches of the shaft whenever the shaft is provided into a given position. There is also provided a slotted plate which is located between the shaft and the cap member such that as the cap member slides on the shaft, it moves within the constraints of the slot on the plate, and is prevented from rotating about the shaft. A lever extends radially from one end of the shaft, and a linking mechanism communicating with said lever is provided for operating a plurality of such locking devices simultaneously. A padlock can be provided for restraining the locking devices simultaneously in the given position wherein the cap member and an associated shaft are restrained from moving with respect to the fixed base.

7 Claims, 4 Drawing Figures

GUN LOCKING DEVICE

This invention relates to a locking device.

More specifically, a mechanism is disclosed for locking and restraining one or more objects of various lengths and diameters or widths in a holding rack of the type in which an end of the object is seated in a depression in a fixed base, the base being secured immovably. The disclosed invention includes a shaft which has a radius which varies with respect to a longitudinal axis for pivoting and further has notches along its length at the point of its largest radius. A cap member, receptive to an end of the object not seated in the base, is slidably mounted upon the shaft and is able to engage the notches of the shaft whenever the shaft is pivoted into a given position. There is also provided a slotted plate which is located between the shaft and the cap member such that as the cap member slides on the shaft, it moves within the constraints of the slot on the plate, and is prevented from rotating about the shaft. A lever extends radially from one end of the shaft, and a linking mechanism communicating with said lever is provided and operating a plurality of such locking devices simultaneously. A padlock can be provided for restraining the locking devices simultaneously in the given position wherein the cap member and an associated shaft are restrained from moving with respect to the fixed base.

DESCRIPTION OF THE PRIOR ART

Several devices exist which attempt to safeguard items such as rifles and shotguns. Typically these items are displayed by stores and collectors with a maximum portion exposed for view. Concurrent with such exposure, it is highly desirable to prevent unauthorized removal of items such as guns from the gun rack. Such devices appear in United States Patents issued to Del Campo, U.S. Pat. No. 2,251,271; Haapala, U.S. Pat. No. 2,855,108; and Pritz, U.S. Pat. No. 4,018,339. The Del Campo patent is limited to guns of a specific length and design, as is Haapala to a lesser extent. Pritz teaches the use of an adjustable device for locking gun, however, each individual gun must be locked and unlocked independently. In addition, the operating mechanisms of these devices are exposed and are thus accessible to prying and tempering by unauthorized persons. The invention to be described more fully hereinafter remedies the deficiencies noted in respect to the prior art and further includes many features not available therein.

It is therefore an object of this invention to provide a locking device which enables an object such as a rifle or shotgun to be displayed and yet provide maximum protection and security from theft, tampering or unauthorized removal of the gun.

A further object of the invention is to provide ready access to more than one rifle or shotgun simultaneously.

Yet another object of the invention is to provide a locking device enclosed and protected in such a manner as to be resistant to prying or tampering by unauthorized persons.

Another object is to provide a locking device receptive to a variety of sizes, widths, diameters, designs or calibers of guns or any suitable object to be protected.

In the attaining of the foregoing objects, the invention provides a locking device for restraining an object in a rack having a fixed base of the type in which an end of said object is seated in a depression in said base, which invention includes a plate having a slot disposed across its surface and having two members at opposite ends of said plate at each end of said slot. A shaft having a longitudinal axis is pivotally mounted about said longitudinal axis at each of its ends to said members, said shaft being aligned parallel with and adjacent to the slot, said shaft having at least one large radius and one small radius relative to said longitudinal axis and further having a row of notches along the large radius of the shaft and arranged in a colinear manner such that said row of notches is parallel to said longitudinal axis of the shaft. A sleeve is slidably mounted upon the shaft and secured to it is a slide which has a protrusion extending through the slot in the plate. Secured to this protrusion where it extends through said plate is a cap member which fits over one end of the object to be secured and in conjunction with the depression in the base into which another end of the object to be secured is seated, prevents removal of the object. There is also provided one or more bars which are secured to the sleeve and can engage any particular notch on the shaft when the shaft is rotated into a given position. Said given position is such that the bar engages a notch of the shaft and prevents further motion of the sleeve. In addition there is at least one flexible tab secured to said sleeve and located in a position relative to the bar such that when said tab engages a notch of said shaft, said bar is able to engage a notch of said shaft when said shaft is pivoted into said given position. There is further provided a lever extending radially from said shaft which lever may be secured in said given position at which given position movement of said sleeve and its attached slide and cap member is prevented. Finally, there is provided a linking means such that a number of these devices may be operated simultaneously; and a locking means which communicates with said linking means such that said lever secured to said shaft of each device is restrained in said given position thereby restraining said cap member.

Other objects and advantages of the present invention will become apparent from the ensuing description of an illustrative embodiment thereof, in the course of which reference is made to the accompanying drawings in which:

FIG. 1 illustrates in three dimensional form the preferred embodiment of the invention, adapted to hold and secure rifles, and FIG. 2 is a partial section of a portion of FIG. 1 illustrating a typical use of the invention in conjunction with a gun, and FIG. 3 represents an exploded view of the preferred embodiment of the invention, and FIG. 3A is a detail view in three dimensional form of a portion of a shaft and sleeve assembly.

DESCRIPTION OF THE PREFERRED EMBODIMENT

Figure 2:
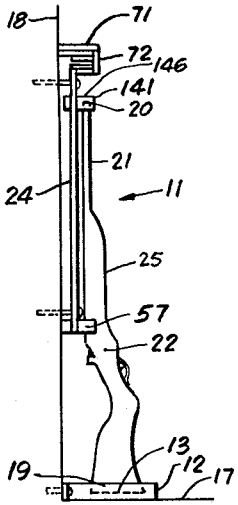
Figure 1:
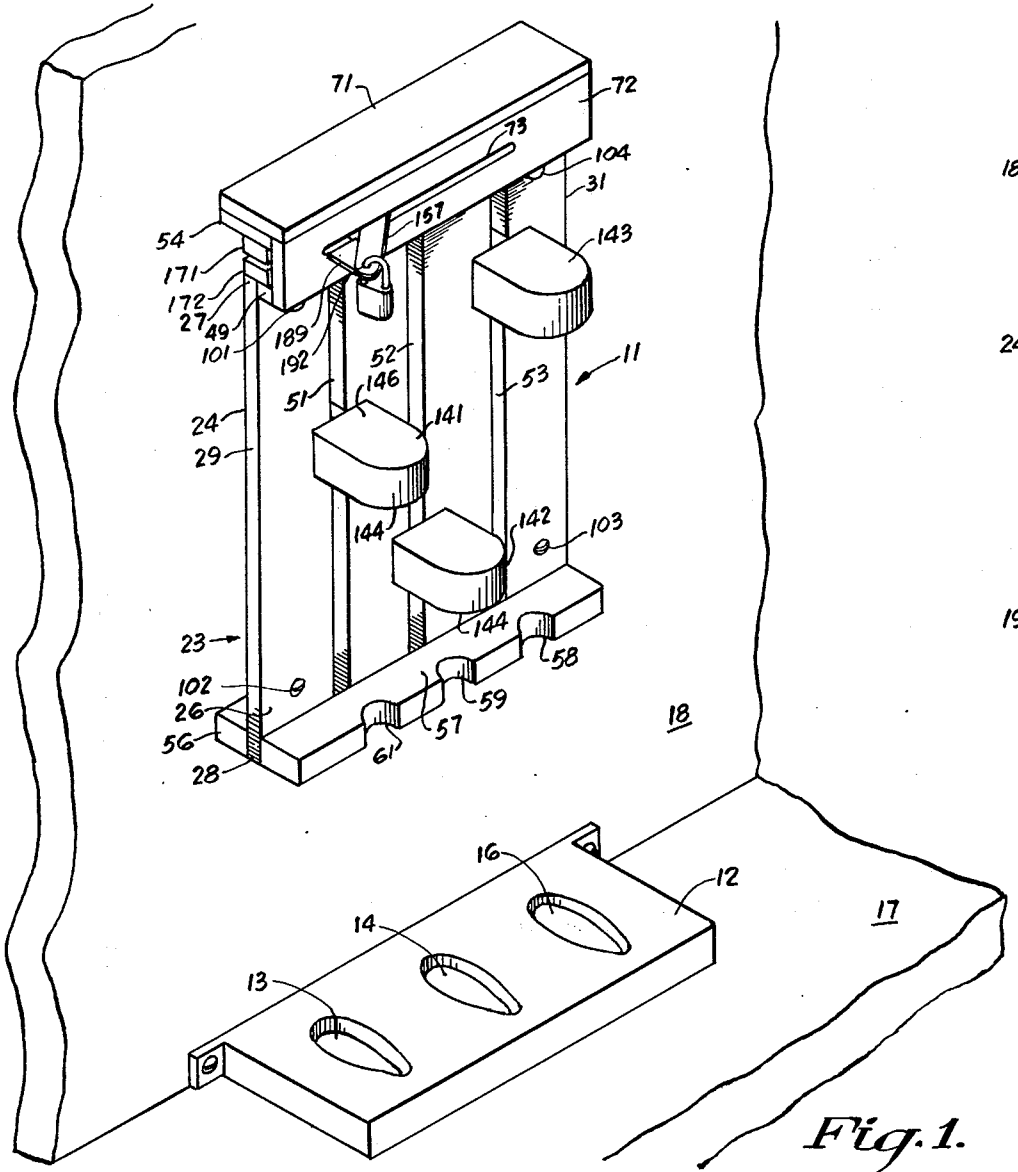

A clearer understanding of the invention will be obtained if FIG. 1 and FIG. 2 are studied in conjunction with the description that follows.

Referring to FIG. 1, there is shown a fixed base 12 with depressions 13, 14 and 16 therein. The base is secured to a floor 17, in close proximity with the juncture of the floor 17 with a wall 18. A plate 23 is mounted to the wall 18 by screws 101, 102, 103 and 104. These may be of the non-extractable type for additional security. The plate 23 has a first end 27, a second end 28, a first edge 29, a second edge 31, a first side 24, and a second side 26. First member 54 extends from first edge 29 to second edge 31 of plate 23 and is secured to top cover 71 and front cover 72 which are secured to first end 27 of plate 23 by spacer 49. Second member 56 is secured to second end 28 of plate 23 and extends from first edge 29 to second edge 31 of plate 23. Plate 23 has slots 51, 52 and 53 which extend from first end 27 of plate 23 to second end 28 of plate 23.

Figure 3A:
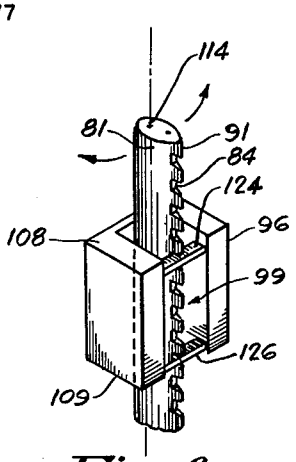
Figure 3:
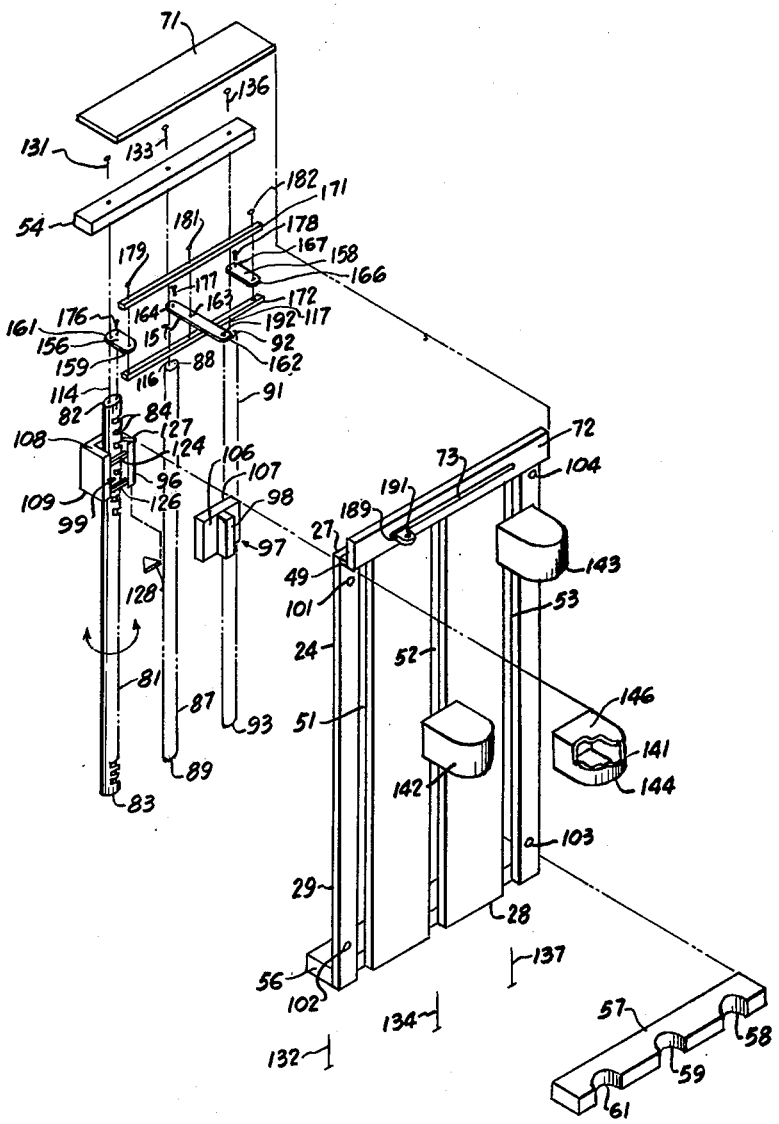

Referring now to FIG. 3, shaft 81, which has a first end 82, a second end 83, and a longitudinal axis 114, is pivotally mounted about longitudinal axis 114 at its first end 82 to first member 54 by pivot pin 131 and is pivotally mounted about longitudinal axis 114 at its second end 83 to second member 56 by way of second pivot pin 132. As may be seen in the upper left hand portion of FIG. 3 of the drawings, first pivot pin 131 extends through first member 54 and lever 156 and into first end 82 of shaft 81 through longitudinal axis 114. Second pivot pin 132 extends through second member 56 and into second end 83 of shaft 81 through longitudinal axis 114. Shafts 87 and 91 are similar to shaft 81 and have first and second ends as shown in phantom outline and are likewise pivotally mounted to the first member 54 and the second member 56. No detailed description will be provided for the locking mechanisms associated with these shafts 87 and 91. The detailed description of shaft 81 and the associated components to be described more fully hereinafter are equally applicable to these shafts 87 and 91. Shaft 81 further has a cross-section such that there exists a locus of points parallel to said longitudinal axis 114 and located at a maximum radial distance from longitudinal axis 114 relative to all other points contained in said cross-section of shaft 81, and shaft 81 further has a row of notches indicated generally by numeral 84 arranged in a substantially collinear manner along the locus of such points and parallel to longitudinal axis 114. It should be noted that although FIGS. 3 and 3A of the drawing of the preferred embodiment may be observed to disclose an elliptical cross-section of shaft 81, which cross-section has at least one large radius and at least one small radius with respect to longitudinal axis 114, other cross-sectional configurations of shaft 81 not shown are contemplated, including without limitation, a shaft having a circular cross-section having a center which allows the shaft to be pivotally mounted eccentrically to first member 54 and second member 56 about a longitudinal axis which does not pass through said center of said circular cross-section. The collinear arrangement of the notches 84 located at said locus of points is such that all points and notches 84 thereon are parallel with longitudinal axis 114 of shaft 81.

A sleeve 96, herein depicted as having a first end 108 and a second end 109 and an open side 99, is slidably mounted on shaft 81. Bars 124 and 126 span open side 99 of sleeve 96; bar 124 is located at first end 108 of sleeve 99 and bar 126 is located at second end 109 of sleeve 96. Bars 124 and 126 can engage notches 84 of shaft 81 upon pivoting of shaft 81 about longitudinal axis 114 into a position defined as a given position.

Secured to sleeve 96 are flexible tabs 127 and 128 which are located at first end 108 and second end 109, respectively, of sleeve 96, at a position relative to bars 124 and 126 such that flexible tabs 127 and 128 can engage notches 84 of shaft 81 upon pivoting of shaft 81 to a position other than the given position, but the position of shaft 81 in which flexible tabs 127 and 128 engage notches 84 is mutually exclusive of said given position of shaft 81 in which bars 124 and 126 engage notches 84. In the preferred embodiment, these relative positions of bars 124 and 126 and flexible tabs 127 and 128 are approximately 90° apart about longitudinal axis 114. Flexible tabs 127 and 128 are composed of a material of sufficient stiffness as to enable them to retain the position of sleeve 96 and slide 97 and cap member 141 which are secured to sleeve 96 as is more fully described hereinafter, by the engagement of flexible tabs 127 and 128 with notches 84. However, flexible tabs 127 and 128 are sufficiently resilient so as to enable sleeve 96, slide 97 and cap member 141 to slide along shaft 81, if urged by an external force applied to cap member 141 parallel with longitudinal axis 114. Upon cap member 141 being so urged, flexible tabs 127 and 128 are able to engage and disengage with the notches 84 of shaft 81 thereby permitting cap member 141 to slide to a desired position whereupon flexible tabs 127 and 128 engage notches 84 and prevent further sliding of cap member 141 as long as no external force is applied to cap member 141. Secured to the open side 99 of sleeve 96 is a slide 97 having a protrusion 98. Slide 97 has a mounting face 107 which is in contact with and secured to open side 99 of sleeve 96. Sliding face 106 of slide 97 communicates with and moves slidably with respect to the first side 24 of plate 23. Protrusion 97 extends from first side 24 of plate 23 through slot 51 to second side 26 of plate 23. Secured to protrusion 97 at a point at which it extends through slot 51 is cap member 141. Cap member 141 is disclosed as being roughly semi-circular in shape having open end 144 and closed end 146. For purposes of illustration cap member 141 is shown as having a portion removed to indicate the presence of open end 144 and closed end 146. Cap members 142 and 143 are of similar construction as to cap member 141. As can best be seen in FIG. 2, open end 144 fits over the object to be secured, in the preferred embodiment, a gun muzzle 20, such that cap member 141 encloses an end of the object inserted therein. Cap member 141 is of sufficient depth so as to allow for small relative movements between gun butt 19 and depression 13.

Secured to first end 82 of shaft 81 is lever 156; similarly locking lever 157 is secured to first end 88 of shaft 87 and lever 158 is secured to first end 92 of shaft 91. In a manner similar to shaft 81, shafts 87 and 91 are pivotally mounted to first member 54 and second member 56 by first pivot pins 133 and 136, respectively, and by second pivot pins 134 and 137, respectively. As may be seen at the top of FIG. 3, first pivot pins 131, 133 and 136 extend through, in sequence, first end 54, and then, respectively, lever 156, locking lever 157 and lever 158 and then into respectively first end 82 of shaft 81, first end 88 of shaft 87 and first end 92 of shaft 91. At the bottom of FIG. 3, second pivot pins 132, 134 and 137 can be seen extending through second member 56 and into second ends 83, 89 and 93 of shafts 81, 87 and 91, thus enabling shafts 81, 87 and 91 to pivot about longitudinal axes 114, 116 and 117 respectively. Although those skilled in the art will note that there are numerous ways of causing simultaneous pivoting of shafts 81, 87 and 91, the preferred embodiment provides a first link 171 and a second link 172. Lever 156, locking lever 157, and lever 158 are pivotally mounted between first link 171 and second link 172 by pins 179, 181 and 182.

Still referring to FIG. 3, lever 156 has first end 159 and second end 161; locking lever 157 has first end 162, hinge point 163 and second end 164; lever 158 has first end 166 and second end 167. First link 171 and second link 172 are pivotally connected to first end 159 of lever 156 by pin 179; to hinge point 163 of locking lever 157 by pin 181; and to first end 166 of lever 158 by pin 182. Pin 176 is inserted through second end 161 of lever 156 into first end 82 of shaft 81 and prevents second end 161 of lever 156 from pivoting relative to first end 82 of shaft 81. Similarly pin 177 prevents second end 164 of locking lever 157 from pivoting relative to first end 88 of shaft 87 and pin 178 prevents second end 167 of lever 158 from pivoting relative to first end 92 of shaft 91. It is now obvious that first link 171 and second link 172 can move parallel to first member 54 as shafts 81, 87 and 91 pivot about longitudinal axes 114, 116 and 117, respectively. Locking lever 157 pivots about longitudinal axis 116, and first end 162 of locking lever 157 thus describes an arc as locking lever 157 moves to and from a locked position in which shafts 81, 87 and 91 are in said given position wherein cap members 141, 142, and 143 are constrained from moving as described above. Locking lever 157 is provided with a hole 192 at its first end 162. Front cover 72 is secured to top cover 71 and spacer 49. Spacer 49 is secured to plate 23 and front cover 72 and provides clearance for movement of first link 171 and second link 172. Front cover 72 has opening 73 through which locking lever 157 extends. Anchor 189 is secured to front cover 72 at a point in proximity to first end 162 of locking lever 157 in its locked position. Anchor 189 has hole 191, which in conjunction with hole 192 of locking lever 157 is receptive to a padlock or other locking device to prevent movement of locking lever 157 from its locked position.

FIG. 3A is a detail of shaft 81, sleeve 96, bars 124 and 126 and notches 84, in a locked position. As may be seen notches 84 are engaged with bars 124 and 126 preventing sleeve 96 from sliding relative to shaft 81.

FIG. 2 is a typical use of the disclosed invention as a gun locking mechanism. The locking device 11 is indicated generally. The butt of gun 19 is seated in a depression 13 in the fixed base 12. The barrel 21 of gun 25 is placed in indentation 61 of barrel rest 57. Cap member 141 is lowered and locked over the muzzle 20 of gun barrel 21. The locking device 11 is secured to wall 18 and fixed base 12 is secured to floor 17.

OPERATION

Operating the locking device first requires locking lever 157 to be moved into an unlocked position such that shafts 81, 87 and 91 are pivoted into a position other than said given position. For simplicity, shaft 81 will be examined as representative in operation of shafts 87 and 91 although the operation of those shafts and their associated components is identical with that of shaft 81 and its associated components. In said given position, bars 124 and 126 do not engage notches 84 of shaft 81, and sleeve 96 is thus movable along shaft 81, but is constrained to non-rotational linear travel along shaft 81 by protrusion 98 and sliding face 106 of slide 97 which communicate with slot 51 of plate 23. As sleeve 96 moves along shaft 81, slide 97 and cap member 141, being attached to sleeve 96, move therewith. The object to be secured, in the preferred embodiment, a gun 25 as shown in FIG. 2, is placed in the gun rack described above such that the gun butt 19 of gun 25 is seated in depression 13 of fixed base 12. The barrel 21 of gun 25 rests in indentation 61 of barrel rest 57. Cap member 141 is lowered to a position in which it covers the gun muzzle 20 of gun 25, at which point flexible tabs 127 and 128 engage notches 84 to retain sleeve 96, slide 97 and cap member 141 at this position.

As locking lever 157 is moved into a locked position, shaft 81 pivots about longitudinal axis 114 and notches 84 leave their engagement with flexible tabs 127 and 128 and engage bars 124 and 126. Because bars 124 and 126 are secured to sleeve 96 as hereinbefore described, sleeve 96, slide 97 and cap member 141 are thus prevented from moving. Cap member 141 has sufficient depth to allow for slight movement of gun 25 within indentation 13 of fixed base 12, and gun 25 is retained between cap member 141 and indentation 13 of fixed base 12. Locking lever 157 may be secured in its locked position to anchor 189 by a padlock inserted through hole 191 of anchor 189 and hole 192 of locking lever 157.

Based on the foregoing description, it may be seen that the present invention provides a device which permits a maximum portion of the item to be protected to be exposed for view and yet provides maximum protection and security from theft, tampering or unauthorized removal of the item. Further, all items such as rifles or guns are accessible upon unlocking of the mechanism. The invention is able to accommodate various lengths, widths or diameters of items such as rifles and the locking device is enclosed in such a manner that it is resistant to prying or tampering by unauthorized persons.

Although but one embodiment of the present invention has been illustrated and described, it will be apparent to those skilled in the art that various changes and modifications may be made therein without departing from the spirit of the invention and the invention is only limited as set forth in the accompanying claims.

I claim:

1. A locking mechanism for restraining an object having at least a first end and a second end in a rack having a fixed base of the type in which said first end of said object is seated in a depression in said base, said locking mechanism comprising:

(a) a shaft having a first end and a second end, and having a longitudinal axis extending from said first end to said second end of said shaft, said shaft further having a cross-section such that there exists a locus of points parallel to said longitudinal axis and located at a maximum radial distance from said longitudinal axis relative to all other points within said cross-section, said shaft further having a plurality of notches longitudinally disposed along said shaft, said notches being arranged in a substantially collinear manner along said locus of points and parallel to said longitudinal axis, said shaft further having an extension radially disposed to said first end of said shaft;

(b) containing means slidably mounted on said shaft, said containing means being receptive to said second end of said object, said containing means further being able to engage said notches of said shaft when said shaft is rotated to a given position;

(c) anti-rotation means, said shaft pivotally mounted to said anti-rotation means at said first end of said shaft and at said second end of said shaft about said longitudinal axis and in communication with said containing means for preventing pivoting of said containing means about said shaft thereby constraining said containing means to slide on said shaft without rotation; and (d) locking means for restraining said extension of said shaft at said given position whereby rotation of said shaft is prevented and further preventing movement of said containing means.

2. The locking mechanism of claim 1 wherein said anti-rotation means includes:

(a) a plate having a first side and a second side and further having a first end and a second end, and further having a first edge and a second edge, said plate having a slot disposed from said first end to said second end and extending from said first side to said second side, said slot being in communication with said containing means;

(b) a first member mounted along said first end of said plate and extending from said first edge of said plate to said second edge of said plate;

(c) a second member mounted along said second end of said plate and extending from said first edge of said plate to said second edge of said plate; and (d) pivoting means for the pivotal mounting of said shaft at the first end and second end of said shaft substantially adjacent and parallel to said slot and said first side of said plate.

3. The locking mechanism of claim 2 wherein said containing means includes:

(a) a sleeve slidably mounted on said shaft;

(b) slide means having a protrusion, said slide means secured to said sleeve such that said protrusion extends from said first side of said plate through said slot to said second side of said plate;

(c) a cap member receptive to said second end of said object and secured to said protrusion of said slide means on said second side of said plate;

(d) at least one bar secured to said sleeve such that said bar can engage a particular notch of said shaft upon rotation of said shaft to a given position; and (e) at least one flexible tab secured to said sleeve in a position relative to said bar such that if said tab engages a notch of said shaft, said bar is able to engage a notch after said shaft is subsequently rotated to said given position.

4. The locking mechanism of claim 3 wherein said extension of said shaft further comprises a lever having a first end and a second end, said lever being secured at its second end in radial disposition to said first end of said shaft and pivotable therewith.

5. The locking mechanism of claim 4 where said locking means includes an anchor to which said first end of said lever may be secured such that said lever and said shaft are restrained in said given position whereby a notch on said shaft engages said bar thereby preventing movement of said sleeve, said slide means, and said cap member.

6. A gun locking mechanism for restraining a gun in a gun rack having a fixed base of the type in which the butt of said gun is seated in a depression of said base, said gun having a barrel with a muzzle mounted on a fixed stock, said fixed stock having a butt portion, said gun locking mechanism comprising:

(a) a plate having a first side and a second side, a first end and a second end, a first edge and a second edge, said plate having a slot disposed from said first end to said second end and extending from said first side to said second side;

(b) a first member mounted along said first end of said plate and extending from said first edge of said plate to said second edge of said plate;

(c) a second member mounted along said second end of said plate and extending from said first edge of said plate to said second edge of said plate;

(d) a shaft having a first end and a second end, said shaft having at its cross-section at least one large radius and at least one small radius and having a plurality of notches longitudinally disposed along said shaft, said notches being arranged in a substantially collinear manner on said large radius, said shaft being pivotally mounted at its first end to said first member and at its second end to said second member in a location substantially adjacent to said second side of said plate and said slot contained in said plate and substantially parallel therewith;

(e) a sleeve, slidably mounted on said shaft;

(f) slide means having a protrusion, said slide means secured to said sleeve such that said protrusion extends from said first side of said plate through said slot to said second side of said plate;

(g) a cap member receptive to said muzzle of said gun secured to said protrusion of said slide means on said second side of said plate;

(h) a lever having a first end and a second end, said lever secured at its second end in radial disposition to said first end of said shaft and pivotable therewith;

(i) at least one bar secured to said sleeve such that said bar can engage with a particular notch of said shaft upon rotation of said shaft to a given position;

(j) locking means communicating with said first end of said lever for restraining said pivoting of said lever and said shaft at said given position whereby a notch on said shaft engages said bar thereby preventing movement of said sleeve, said slide means and said cap member; and (k) at least one flexible tab secured to said sleeve in a position relative to said bar such that if said tab engages a notch of said shaft, said bar is able to engage a notch after said shaft is subsequently rotated to said given position.

7. The gun locking mechanism of claim 6 which includes in combination:

(a) a plurality of said gun locking mechanisms wherein said plate has a plurality of slots disposed from said first end to said second end of said plate for communication with said gun locking mechanisms, and further, wherein said first and second members extend from said first edge of said plate to said second edge of said plate; and (b) linking means for operating said plurality of said gun locking mechanisms simultaneously, said linking means being responsive to said locking means and restrainable therewith.

* * * * *